United States Patent [19]

Watts

[11] Patent Number: 4,730,851

[45] Date of Patent: Mar. 15, 1988

[54] DOWNHOLE EXPANDABLE CASTING HANGER

[75] Inventor: Gerald D. Watts, Richmond, Tex.

[73] Assignee: Cooper Industries, Houston, Tex.

[21] Appl. No.: 882,873

[22] Filed: Jul. 7, 1986

[51] Int. Cl.[4] ..... F16L 39/00

[52] U.S. Cl. ..... 285/4; 285/141; 285/317; 285/320

[58] Field of Search ..... 285/4, 140, 141, 142, 285/143, 320, 321, 317; 166/208, 213, 214

[56] References Cited

U.S. PATENT DOCUMENTS

| | | | |
|---|---|---|---|
| 2,003,446 | 6/1935 | Imler et al. | 285/143 |
| 2,010,284 | 8/1935 | Wickersham | 285/143 |
| 3,420,308 | 1/1969 | Putch | 285/140 |
| 3,741,589 | 6/1973 | Herd et al. | 285/321 |
| 3,893,717 | 7/1975 | Nelson | 285/141 |
| 4,051,896 | 10/1977 | Amancharla | 166/208 |
| 4,139,059 | 2/1979 | Carmicheal | 285/4 |
| 4,468,055 | 8/1984 | Reimert | 285/141 |

*Primary Examiner*—Randolph A. Reese
*Assistant Examiner*—Anthony Knight
*Attorney, Agent, or Firm*—E. E. Scott; R. L. Maxwell

[57] ABSTRACT

A hanger assembly 10 for suspending an inner pipe string 32 within an outer casing 16 from a particular location therein. The hanger assembly includes a hanger body 30 and an expandable locking assembly 46 comprised of a plurality of latching fingers 77 secured at their lower ends about the hanger body by a split retainer ring 48 which permits limited pivotal movement of the latching fingers about their lower ends. Each latching finger 47 is provided with a hook surface 71 adjacent its upper end adapted to engage an upward facing abutment 20 on the inner profile of the outer casing. The free ends of the latching fingers are urged outwardly by a circular spring 58. The retainer 48 and locking assembly 46 are secured to the hanger body 30 by a connecting shear ring 55 which restrains relative axial movement of the locking assembly on the hanger body until the latching fingers hook on the inner profile of the outer casing whereby the shear ring 55 is parted by a predetermined weight of the inner pipe string and the hanger body 30 slides downward to lock the fingers 47 in latched relation with the outer casing 16. By uplifting the hanger 30, cooperating cam surfaces 72, 75, 19, 26 on the fingers 47 and outer casing 16 permit extraction of the inner pipe string 32 if desired.

6 Claims, 6 Drawing Figures

DOWNHOLE EXPANDABLE CASTING HANGER

BACKGROUND OF THE INVENTION

This invention relates to hanger devices for suspending pipe or casing in wells, and more particularly to a well casing hanger of the expanding type which can be positioned at any desired place in an outer casing string, including the ocean floor, to suspend an inner casing string within the outer casing.

Where wells are drilled in off-shore locations it is generally desirable to suspend the several concentric casing strings of the well at a support point located at or near the ocean floor. Each casing string is suspended from a hanger device which fastens the casing string to the next adjacent outer casing string. While in general these hanger devices operate satisfactorily, there are nevertheless associated problems. One such hanger device, disclosed in U.S. Pat. No. 4,139,059, utilizes a resilient expandable and contractible locking assembly which is machined with frusto-conical tapered surfaces and is of a diameter larger than the bore of the adjacent outer casing. When pushed into the outer casing and contacted therein, the locking assembly is continually self-biased to expand outwardly whereby it is adapted to be run through the outer casing to engage a hanger coupling installed as a segment in the outer casing string at the mudline. The machining of frusto-conical surfaces increases the cost and complexity of such a hanger assembly. In addition, the latching fingers of the locking assembly are of considerable length and are consequently subjected to undesirable bending stresses when the device is operational. Another hanger device, disclosed in U.S. Pat. No. 3,893,714, utilizes a resilient self-expanding locking ring assembly and as an alternative one characterized by a plurality of spring-loaded dogs.

The considerable length and complexity of these assemblies are likewise associated with considerable machining costs and bending stresses which reduce tolerances in regard to material defects.

Accordingly, it is an object of the invention to provide a new and improved well casing hanger assembly which is simple and economical to manufacture.

Another object is to provide an improved well casing hanger assembly of the expanding type which is shorter in length than currently existing hanger assemblies and thereby avoids the imposition of bending stresses on its expander components.

A further object is to provide a new and improved casing hanger assembly of the expanding type which comprises an expandable latching assembly of a plurality of latching fingers which are mounted on the hanger body for pivotal movement about their lower ends and are continually spring biased to expand outwardly at their upper ends to releasably latchingly engage a hanger coupling segment in an outer casing string.

SUMMARY OF THE INVENTION

The hanger assembly of this invention comprises a hanger body and an expandable locking assembly unit which includes a plurality of latching fingers. The latching fingers are secured at their lower ends to the hanger body by a split retainer ring which permits limited pivotal movement of the latching fingers about their lower ends. The upper ends of the latching fingers are continually urged to an expanded position by a spring. The retainer halves are themselves secured to the hanger body by a shear ring which threadedly connects the expandable locking assembly and the hanger body. In the running position, the latching fingers are free to pivot in out as the hanger is run. The outer configuration of the latching fingers is such that the hanger will easily pass through preventers and other equipment in the outer casing string without tending to "hang up". However, when the hanger assembly reaches its mating hanger coupling which is installed near the mudline in the outer casing string or at some other desired location therein, the upper ends of the latching fingers are expanded outwardly to snap into the mating profiled recess in the outer hanger coupling segment. Hook portions provided on the exteriors of the latching fingers at their upper ends, engage stop shoulders formed in the outer casing string to arrest further downward movement of the hanger assembly. As the inner casing continues its downward movement, the threaded shear ring will part thereby allowing an upper shoulder of the hanger body to move under the latching fingers to lock them in place and the hanger support ring to rest on the top of the expanded latching fingers. Cooperating cam surfaces provided on the exterior of the latching fingers and the interior profile of the hanger coupling segment, permit extraction of the inner casing string if desired, by camming the upper ends of the latching fingers inwardly to overcome the outward bias of the biasing spring whereby the hanger assembly is disposed to a contracted, compressed condition suitable for running through the outer casing.

BRIEF DESCRIPTION OF THE DRAWINGS

In the accompanying drawings which form part of the specification and are to be read in conjunction therewith.

Figure 1:
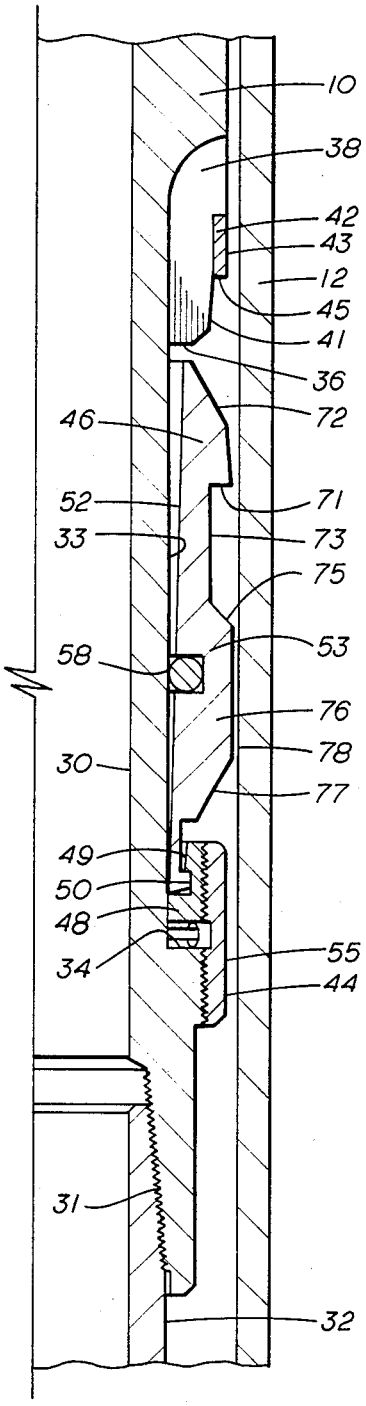
FIG. 1 is a longitudinal sectional view of the latching or locking assembly shown attached in position on the hanger body of the invention and in the condition of being run into an outer casing string with an inner pipe string suspended from the hanger body.

Referring more particularly to the drawings, a casing hanger 10 is shown in FIG. 1 as being lowered by a running tool (not shown) within an outer casing 16.

Figure 2:
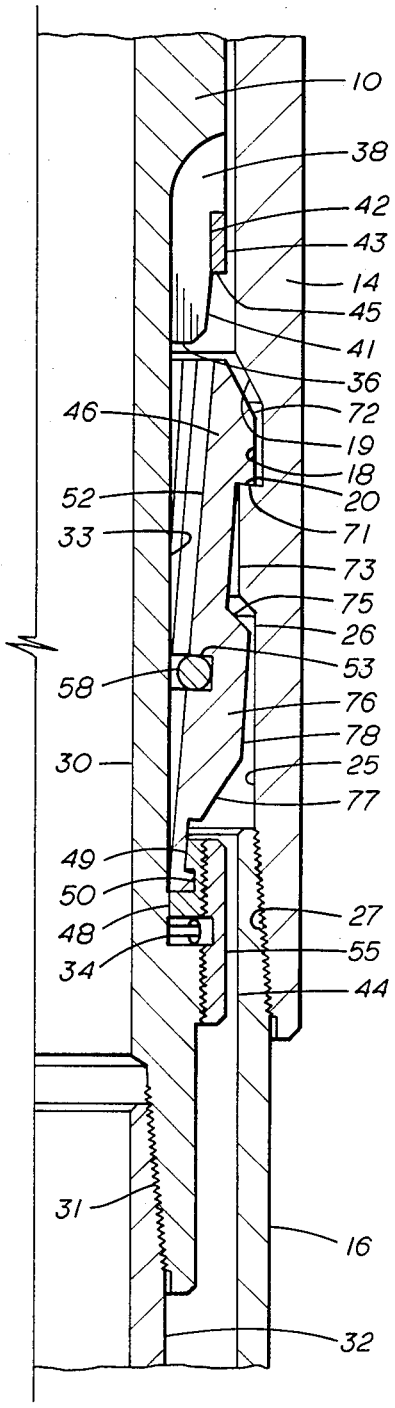
FIG. 2 is a longitudinal sectional view similar to FIG. 1 but showing latching fingers of the locking assembly of the invention received in the outer pipe casing prior to the shearing of the shear ring component of the invention.
Figure 3:
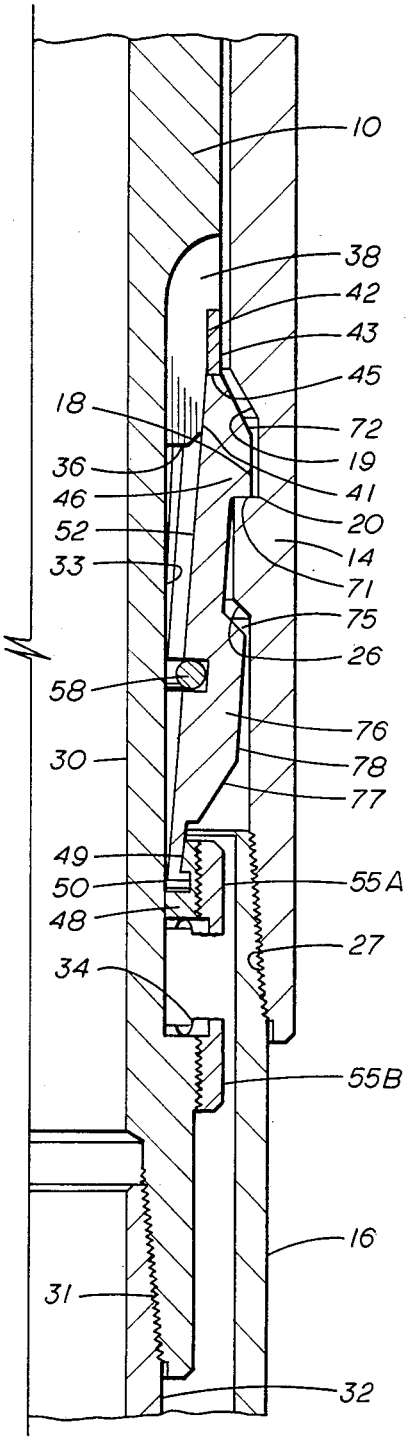
FIG. 3 is a longitudinal sectional view similar to FIGS. 1 and 2 showing the locking assembly after the shearing of the shear ring and after the inner casing has moved downwardly with an enlarged diameter locking surface of the hanger body moving behind the latching fingers to hold the fingers in outwardly latched position.
Figure 5:
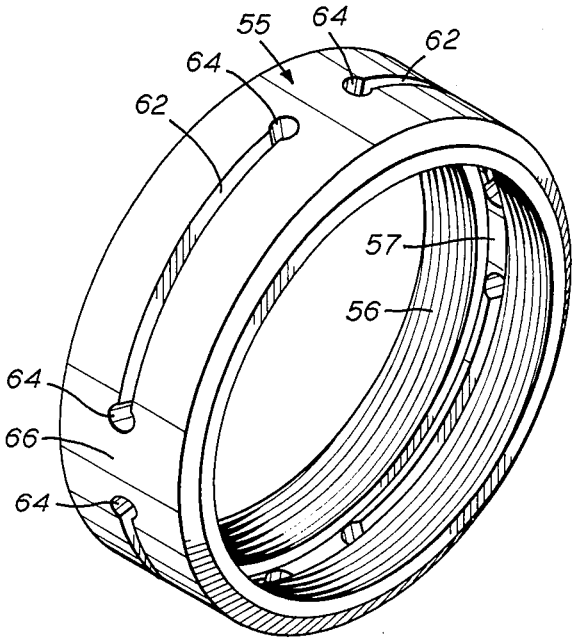
FIG. 5 is a perspective view of the shear ring element of the invention, which secures the plurality of latching fingers on the hanger body.
Figure 6:
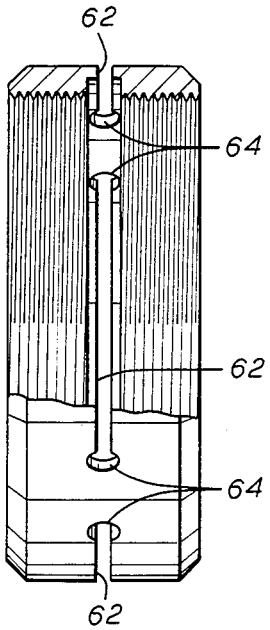
FIG. 6 is a sectional view, partly in elevation, of the shear ring of FIG. 5.

FIGS. 2 and 3 show a tubular hanger coupling 14 which is connected as a segment in the outer casing string 16. The hanger coupling 14 is provided with an annular inner groove near the upper end thereof which defines an inner cylindrical annular surface 18, a downward facing annular shoulder 19, and an upwardly facing lower shoulder 20 which, in essence, is a frusto-conical surface convergent inwardly towards the axis of the casing string. In its lower end portion, the hanger coupling 14 is grooved to provide a larger inner diameter section 25 and a downward facing frusto-conical cam surface 26. Internal threads 27 are provided in the lower end of the hanger coupling 14 which accommodates its threaded connection to the outer casing string 16. A similar connection (not shown) is effected at the upper end of the hanger coupling segment 14 with the upper portion of the outer casing string.

The casing hanger 10 is provided with a tubular hanger body 30 and internal threads 31 in its lower end portion for accommodating its threaded connection to an inner casing string 32 which is suspended therefrom. An intermediate portion of the hanger body 30 is externally grooved to provide an outwardly facing recessed cylindrical surface 33, an upward facing annular abutment 34 at the lower end of the groove, and a downward facing upper annular abutment 36. A plurality of circumferentially spaced axially extending slots 38 are formed in the exterior of the hanger body 30 at the upper end of the external groove which divide the abutment 36 and provide flow passages in the annular space between the outer casing and the hanger body 30. This external surface portion of the hanger body 30 which accommodates the slots 38 is also grooved to provide an arcuate frusto-conical locking surface 41 with a smallest cross-sectional diameter which is larger than that of cylindrical surface 33 but which is severed by the slots 38.

A cylindrical recessed surface 42 is also formed in the hanger body exterior which joins the frusto-conical surface 41 and is also severed by the slots 38. A hanger support ring 43 is press fit on the hanger body 30 about the surfaces 42. A downward facing surface 45 provided by the bottom end of the hanger support ring 43 provides an upper stop shoulder for purposes hereinafter described. Adjacent its lower end, the hanger body 30 is provided with external threads 44.

A locking assembly 46 which is adapted to releasably support the hanger body 30 within the outer casing string in the hanger coupling segment 14 includes a plurality of latching fingers 47 which are arranged to fit around the hanger body 30 in sleeved relation thereto. The latching fingers 47 are retained by a split retainer ring 48, the halves of which seat on the upward facing shoulder 34 in the hanger body 30. Before being split, the retainer ring 48 is counterbored at its upper end portion to provide an intermediate diameter bore section 49 which is grooved in its lower end portion to provide an inner annular groove 50. The bore section 49 is a tapered frusto-conical section which is convergent downwardly. The lower end portions of the latching fingers 47 are formed with sections **47*a*, 47*b* conforming substantially to the inner diameters of the lower end of the bore section 49 and the groove 50 of the halves of retainer ring 48 whereby a boss 51 at the lower end of each latching finger is received in the groove 50** of the retainer ring.

The split retainer ring 48 is formed with external threads conforming in size and dimension to the external threads 44 on the lower end portion of the hanger body 30.

A connecting shear ring 55 which is used to secure the retainer ring 48 in place on the hanger body 30 is provided with internal threads 56 and an inner annular groove 57 intermediate its ends which extends about its entire inner circumference to form a weakened reduced thickness portion. Formed in the portion are four segmental arcuate cuts or notches 62, each extending about eighty degrees (80°) of arc in the surface of the ring 55. Each cut 62 is terminated at each end by an enlarged opening 64. Accordingly, there are four sections 66 of the shear ring 55 extending between the cuts 62, each corresponding to approximately ten (10°) degrees of one of the shear ring 55 whereby the shear ring is adapted to shear along these sections at a predetermined pipe loading. Obviously, the numbers, sizes, and dimensions of the cuts might be other than shown to accommodate shearing at different pipe loadings.

It is also to be noted that the lower end surfaces of each of the latching fingers 47 is a downward facing segment of a frusto-conical surface which is convergent inwardly whereby each finger secured against the recessed cylindrical surface 33 of the hanger body 30 with its lower boss 51 received in the retainer ring 48 is permitted a limited pivotal movement about its lower end.

Figure 4:
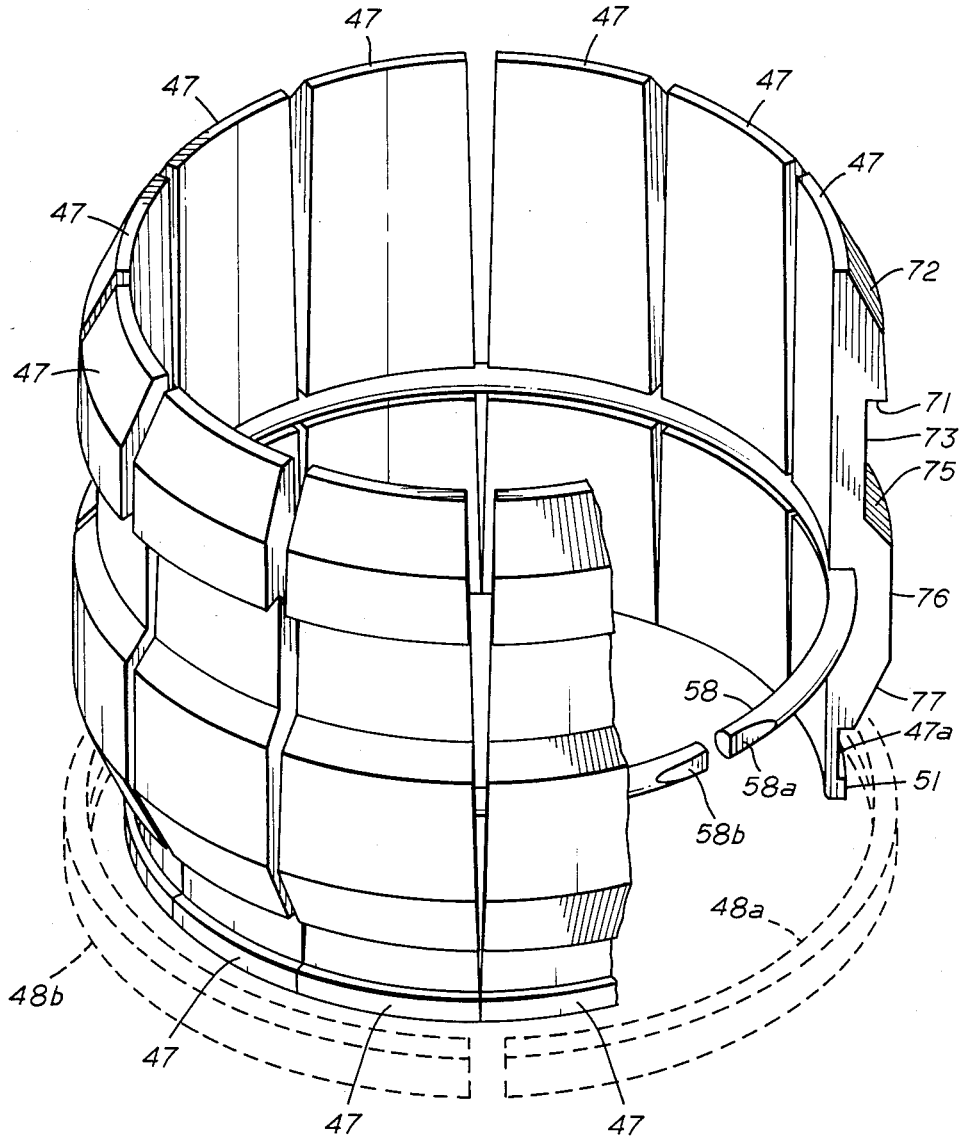
FIG. 4 is a fragmentary perspective view of the resiliently expandable and contractible locking assembly of the invention to show its orientation as it would appear in sleeved relation about the hanger body and with some of the spring-loaded latching fingers omitted and the retainer ring shown in broken lines and exploded therefrom for purposes of clarity.

Each of the latching fingers 47 is formed with an inner arcuate cylindrical surface 52 conforming in radius of curvature with that of the recessed cylindrical surface 33 of the hanger body 30. Intermediate its ends, the inner surface 52 is grooved to provide a recess 53. As assembled, the latching fingers 47 are disposed in a circular arrangement as shown in FIG. 4.

The latching fingers 47 are yieldably urged toward an expanded position by a biasing means such as a split circular spring 58 which is received in each of the grooved recesses 53. In its natural unforced state, the spring 58 is of larger diameter than that of the surface 33 of the hanger body and a gap exists between its split ends. To preclude the possibility of the ends of the spring 58 catching on the inner surfaces of the fingers 47, external bevelled surfaces **58*a*, 58*b* are formed on the end portions of the spring 58**.

As assembled on the hanger body 30 for running through the outer casing, the fingers 47 of the locking assembly 46 are arranged in circular sleeved fashion about the recessed surface 33 of the hanger body. The lower end of each latching finger 47 is held secured against the hanger body with the boss 51 at its lower end retained in the inner groove 50 of the split retainer ring 48. The retainer ring itself, both halves thereof, are held fixed on the hanger body by the shear ring 55 which threadedly connects the locking assembly 46 and the hanger body 30, as shown in FIGS. 1 and 2.

Each of the latching fingers 47 is provided on its exterior with an upper hook like portion defined by a notched portion adjacent its upper end which defines a downwardly facing stop shoulder 71 also facing toward the inner axis of the hanger body 30 with a taper conforming to that of the shoulder 20 in the hanger coupling 14. An upper outward facing arcuate cam surface 72 is also formed on the upper end portion of each latching finger 47 extending to the end thereof. Below the stop 71 the latching finger is grooved externally to provide a recessed arcuate surface 73 immediately below the stop 71 and an upwardly and outwardly facing cam surface 75. Each latching finger 47 also includes a boss 76 which at its upper end provides the upper cam surface 75 and at its lower end, is provided with a downward and outward facing cam surface 77. The cam surface 77 terminates at the reduced diameter section 47*a* in the lower end of the latching finger. Between the upper and lower cam surfaces 75, 77 the boss 76 defines an intermediate arcuate surface 78.

In operation, the hanger body 30 with locking assembly 46 installed thereon is secured to a suitable running tool (not shown) and run into the bore of the outer casing string 16. As the hanger assembly 10 moves through the outer casing string, the arcuate surface 78 of the boss 76 of each latching finger 47 is adapted to ride along the inner wall surface of the outer casing string 16 as the fingers 47 are continuously urged outwardly by the split circular spring 58. Accordingly, when the upper ends of the latching fingers 47 are lowered to a position where they are disposed adjacent the recessed surface 18 in the hanger coupling segment 14 in the outer casing string, the upper ends of the fingers 47 are moved outwardly by the spring 58 by pivotal movement on their lower ends whereby stop shoulders 71 on the fingers 47 engage the upward facing annular shoulder 20 in the hanger coupling 14 as shown in FIG. 2. Upon further lowering of the inner casing string 32, the weight of the casing string 32 results in the shearing of the connecting shear ring 55 along the sections 66 thereof whereby the upper section 55A of the shear ring 55 is severed from its lower section 55B as shown in FIG. 3.

Further lowering of the hanger body 30 causes the locking surfaces 42 of the hanger body to move behind the fingers 47 as shown in FIG. 3 and the downward facing upper stop 45 provided by the hanger support ring 43 engages the upper ends of the latching fingers 47 to hold the hanger body 30 in a releasably locked latched postion. In this condition, the latching fingers 47 are prevented from being moved inwardly by the locking surfaces 42.

If it is desired to move the inner casing string 32 upwardly, a suitable tool may be again connected to the hanger body 30 whereby an upward lifting action on the hanger 30 will result in the latching fingers 47 being cammed inwardly by the interaction of the cam surfaces 72 and 75 of the latching fingers with the cam surfaces 19 and 26, respectively, of the hanger coupling 14 whereby the hanger assembly is in its contracted, compressed condition and upward movement of the inner casing string 32 through the outer casing string is permitted.

It will therefore be seen that a new and improved well casing hanger assembly is disclosed herein which is simple to operate and economical to manufacture. Because of the unique pivoted mounting of the latching fingers, these fingers can be made of considerably shorter length than the self-biasing type and therefore avoid undesirable bending stresses that are typically present in the prior art hangers. The fingers may also be cast or made from plate material which reduces machining and costs.

It is also to be understood that the foregoing description of a preferred embodiment of the invention has been presented for purposes of illustration and description and is not intended to limit the invention to the precise form disclosed. For example, the number of cuts in the shear ring 60 and their dimensions may vary from that disclosed herein or shear pins in a shear ring as disclosed in U.S. Pat. No. 4,420,308 might be used as an alternative. The number and configuration of the spring means for continually biasing the latching fingers 47 towards an expanded condition might also be varied as well as the precise configuration of the latching fingers themselves. It is to be appreciated therefore that changes may be made by those skilled in the art without departing from the spirit of the invention.

What is claimed is:

1. A hanger assembly for suspending an inner pipe string within and from an outer casing comprising:

an elongated tubular hanger body with one end adapted for releasable connection to a well tool and the other end adapted as a lower end for connection to an inner pipe string;

said hanger body having a recessed exterior surface portion intermediate its ends and an enlarged diameter locking surface superjacent said recessed portion;

a locking assembly sleeved around the recessed surface portion of the hanger body, said locking assembly being comprised of a plurality of longitudinally extending latching fingers arranged circumferentially about the hanger body, said locking assembly including a retainer ring divided into a pair of semi-circular elements arranged in co-planar circumferential relation around the hanger body and about the lower ends of the latching fingers;

cooperative means on said semi-circular retainer elements and said latching fingers for mounting the latching fingers to the hanger body for limited pivotal movement about their lower ends, means for connecting said semi-circular retainer elements to the hanger body whereby said locking assembly is connected to the hanger body;

means for continually and yieldably urging the free ends of the latching fingers away from the hanger body whereby said locking assembly is continually biased toward an expanded condition;

said means for continually and yieldably urging the free ends of the latching fingers comprises a split circular spring carried on the inner surfaces of each of the latching fingers to urge pivoted movement of the latching fingers about their lower ends;

a downward facing stop surface provided on each said latching finger adjacent the upper free end thereof whereby when said hanger assembly with a pipe string suspended therefrom is lowered into an outer casing string, the latching fingers of the locking assembly are adapted to expand outwardly at their free ends in pivotal movement about their lower ends whereby the stop surfaces thereon are adapted to engage a mating surface formed in the inner profile of a segment of the outer casing string and arrest further downward movement of the hanger assembly; and shear means for restraining relative axial movement of the locking assembly on said hanger body until the stop surfaces of the latching fingers engage said mating surfaces of the outer casing string whereby the shear means for restraining relative axial movement is adapted to be shorn by a predetermined weight of the pipe string to permit relative sliding movement between the latching fingers and the hanger body whereby the locking surface holds the upper ends of the latching fingers in expanded latched relation with the outer casing and prevents inward movement of the upper ends of the latching fingers.

2. A hanger assembly as set forth in claim 1 wherein each of said latching fingers is provided on its outer facing surface with an enlarged hook portion adjacent its upper end, said hook portion defining a downwardly facing abutment adapted to engage an upwardly facing abutment on the inner profile of the outer casing.

3. A hanger assembly as set forth in claim 1 further including cam surfaces on the exteriors of said latching fingers cooperable with mating cam surfaces provided on the inner profile of the outer casing as an upward lifting force is applied to the hanger body to thereby force the latching fingers to retracted collapsed condition against the hanger body whereby the hanger assembly and pipe string suspended therefrom may be withdrawn from the outer casing string.

4. A hanger assembly for suspending an inner pipe string within and from an outer casing comprising:

an elongated tubular hanger body with one end adapted for releasable connection to a well tool and the other end adapted as a lower end for connection to an inner pipe string;

said hanger body having a recessed exterior surface portion intermediate its ends and provided with external screw threads subjacent said recessed portion and an enlarged diameter locking surface superjacent said recessed portion;

a locking assembly sleeved around the recessed surface portion of the hanger body, said locking assembly being comprised of a plurality of longitudinally extending latching fingers arranged circumferentially about the hanger body, said locking assembly including a retainer ring divided into a pair of semi-circular elements arranged in co-planar circumferential relation around the hanger body and about the lower ends of the latching fingers;

cooperative means on said semi-circular retainer elements and said latching fingers for mounting the latching fingers to the hanger body for limited pivotal movement throughout a limited angle of movement about their lower ends, each said semi-circular retainer element being provided with external threads corresponding to those provided on the exterior of the hanger body subjacent its recessed surface portion;

a connecting ring having internal threads cooperatively engaged with the external threads of the semi-circular retainer elements and the external threads of the hanger body subjacent its recessed surface portion whereby the connecting ring connects the locking assembly to the hanger body;

means for continually and yieldably urging the free ends of the latching fingers away from the hanger body whereby said locking assembly is continually biased toward an expanded condition;

said means for continually and yieldably urging the free ends of the latching fingers comprises a split circular spring carried on the inner surfaces of each of the latching fingers to urge pivotal movement of the latching fingers about their lower end;

a downward facing stop surface provided on each said latching finger adjacent the upper free end thereof whereby when said hanger assembly with a pipe string suspended therefrom is lowered into an outer casing string, the latching fingers of the locking assembly are adapted to expand outwardly at their free ends in pivotal movement about their lower ends whereby the stop surfaces theron are adapted to engage a mating surface formed in the inner profile of a segment of the outer casing string and arrest further downward movement of the hanger assembly, said connecting ring having a weakened portion whereby said ring is adapted to fail at said weakened portion from the weight of the inner pipe string to permit relative sliding movement between the latching fingers and the hanger body whereby the locking surface holds the upper ends of the latching fingers in expanded latched relation with the outer casing and prevents inward movement of the upper ends of the latching fingers.

5. A hanger assembly as set forth in claim 4 wherein each latching finger is provided with an outwardly projecting boss at its lower end, said semi-circular elements are each provided with a groove extending throughout its semi-circular internal surface and the bosses of the plurality of latching fingers are received in the semi-circular grooves of the semi-circular retainer elements, the lower end of each said latching finger being defined by an upwardly and outwardly inclined surface and the semi-circular retainer elements being each provided above its internal groove with an upward facing tapered surface whereby each latching finger is adapted for limited pivotal movement about its lower end.

6. A hanger assembly as set forth in claim 4 wherein each of said latching fingers is provided on its outer facing surface with an enlarged hook portion adjacent its upper end, said hook portion defining a downwardly facing abutment adapted to engage an upwardly facing abutment on the inner profile of the outer casing.

* * * * *